US006000344A

United States Patent [19]

Martin

[11] Patent Number: 6,000,344

[45] Date of Patent: Dec. 14, 1999

[54] TABLETOP ASSEMBLY FOR SECURING ARTICLES

[76] Inventor: Rink Earl Martin, 5 Troy Ct., Petaluma, Calif. 94952

[21] Appl. No.: 09/083,658

[22] Filed: May 22, 1998

[51] Int. Cl.[6] ..... A47B 41/04

[52] U.S. Cl. ..... 108/28; 108/137

[58] Field of Search ..... 108/28, 65, 69, 108/137, 143; 269/100, 900

[56] References Cited

U.S. PATENT DOCUMENTS 4,337,709 7/1982 Nicholson ..... 108/42 X 4,989,654 2/1991 Berkeley ..... 269/100 X 5,584,254 12/1996 Williams ..... 108/118

*Primary Examiner*—Janet M. Wilkens

*Assistant Examiner*—Karlena D. Schwing

*Attorney, Agent, or Firm*—Ted Masters

[57] ABSTRACT

A tabletop assembly (20) for securing articles against high acceleration loads includes a substantially planar tabletop (22) having a top surface (24) and an opposite bottom surface (26). At least one article-receiving track (28) is inset into the top of tabletop (22). A brace (36) is disposed beneath the tabletop (22) and connected to the track (28) so that the track (28) will not separate from the tabletop (22) under high acceleration loads such as from a seismic event.

9 Claims, 6 Drawing Sheets

TABLETOP ASSEMBLY FOR SECURING ARTICLES

TECHNICAL FIELD

The present invention pertains to devices for securing articles such as electronic equipment in a fixed position upon the surface of a table, and in particular to a motion-accommodating tabletop assembly which firmly anchors the articles even in the event of seismic activity.

BACKGROUND ART

Devices for holding articles in a fixed position are well known in the art. One category is those devices which fasten an article to a flat horizontal surface for the purpose of performing work on the article (such as woodworking, metalworking, and the like). For example, U.S. Pat. No. 5,584,254 illustrates a collapsible work bench apparatus for use with clamps and conventional power tools. The work bench includes two pairs of support legs pivotally connected to two pairs of strut arms. An apertured support surface includes inboard and outboard channels that may be joined together to other work bench apparatus in both end-to-end and side-to-side fashion by a locking clip and a locking bar. The channels are designed to receive diverse accessories and clamping systems for the purpose of securing workpieces to the support surface. U.S. Pat. No. 5,505,438 discloses a work piece locating apparatus for a burn table. The apparatus has a locator which is moveable with the work piece and a second position at which the locator is spaced from the work piece. U.S. Pat. No. 4,989,654 describes a woodworking work table assembly having an extruded T-slot. The worktable assembly includes a worktable having a work supporting surface and an elongated slot formed therein. A guide insert is positioned within the slot. U.S. Pat. No. 4,022,454 depicts a universal self-aligning locator for supporting a plurality of parts in their proper relative position for assembly and/or clamping to a machine bed and the like. The locator includes a support member having a base leg with a cam locking device for engagement with a T-slot on the machine bed. U.S. Pat. No. 1,329,728 shows a universal clamp tool for rigidly holding stock of a round or other shape during the performance of machine operations upon the stock. A base slides along T-slots in a machine bed.

Another category of device is specifically designed to mitigate the effects of seismic events. These devices secure articles to a substantially horizontal planar surface such as a tabletop using an upwardly projecting unistrut and associated restraint. However, the aforementioned device is difficult to use in that (1) an article can only be connected at one marginally accessible point at the back of the table, therefore requiring the user to awkwardly stretch, (2) the track requires adjustment, and (3) because of the upwardly projecting track, the device is not generally useful as a flat tabletop surface.

While each of these aforementioned devices adequately serve their intended purpose, they do not address the needs of a typical work station in a modern day industrial setting (such as for securing expensive electronic equipment to a horizontal work surface). Specifically, these prior art devices do not include the structural features necessary to withstand the shock and vibration resulting from a seismic event.

DISCLOSURE OF INVENTION

Prior art tabletop securing devices and systems are designed to hold articles in place under static conditions.

These devices are not well suited to a high acceleration environment such as would be experienced during an earthquake. In such an environment, articles can fall or be propelled from the tabletop, become damaged or ruined, occasion injury to personnel, start fires, block access routes and passageways, etc. Conversely, the present invention is directed to a tabletop assembly which is specifically designed to withstand the shock and vibration forces associated with a seismic event. As such, articles attached to the present tabletop assembly via track attachment slots will have a much higher probability of surviving a seismic event without becoming detached or damaged. A brace which is located underneath the tabletop of the present invention prevents the tracks from being separated from the tabletop, and serves to strengthen the entire tabletop assembly.

The present invention is "user friendly" in that articles are easy to attach and remove. Further, the tabletop assembly is designed to fit any support frame and legs with a minimum of installation difficulty. Additionally, by using a cap to cover the unused portion of the attachment slots, the tabletop assembly presents a flat surface suitable for desk top work.

In accordance with a preferred embodiment of the invention, a tabletop assembly for securing articles includes a substantially planar tabletop having a top surface and an opposite bottom surface. At least one track is inset into the tabletop, the track having a top surface and a bottom, the top surface of the track being substantially coplanar with the top surface of the tabletop. The track has an upward-facing longitudinal attachment slot to accommodate the attachment of articles. A brace is disposed beneath and preferably abuts the bottom surface of the tabletop. The brace is connected to the bottom of the track so that the track is held firmly in place and cannot lift out of the tabletop under high acceleration loads.

In accordance with an important aspect of the invention, the bottom of the track has a downward-facing longitudinal attachment slot, and a connector connects the downward facing-longitudinal attachment slot to the brace.

In accordance with an important feature of the invention, the tabletop has a plurality of tracks spaced apart in substantially parallel relationship. The brace comprises a longitudinal member oriented substantially perpendicular to the tracks, the brace being connected to the bottom of each track. In a preferred embodiment, a plurality of braces are spaced apart in substantially parallel relationship.

In accordance with another important aspect of the invention, the tabletop includes a plurality of tabletop segments separated by the tracks. The brace is connected to the bottom surface of each tabletop segment, thereby forming a structurally ridged unit.

In accordance with another important feature of the invention, a cap selectively covers the upward-facing longitudinal attachment slot, and forms a coplanar surface with the top surface of the tabletop.

In accordance with another aspect of the invention, the upward-facing and downward-facing attachment slots are T-slots.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
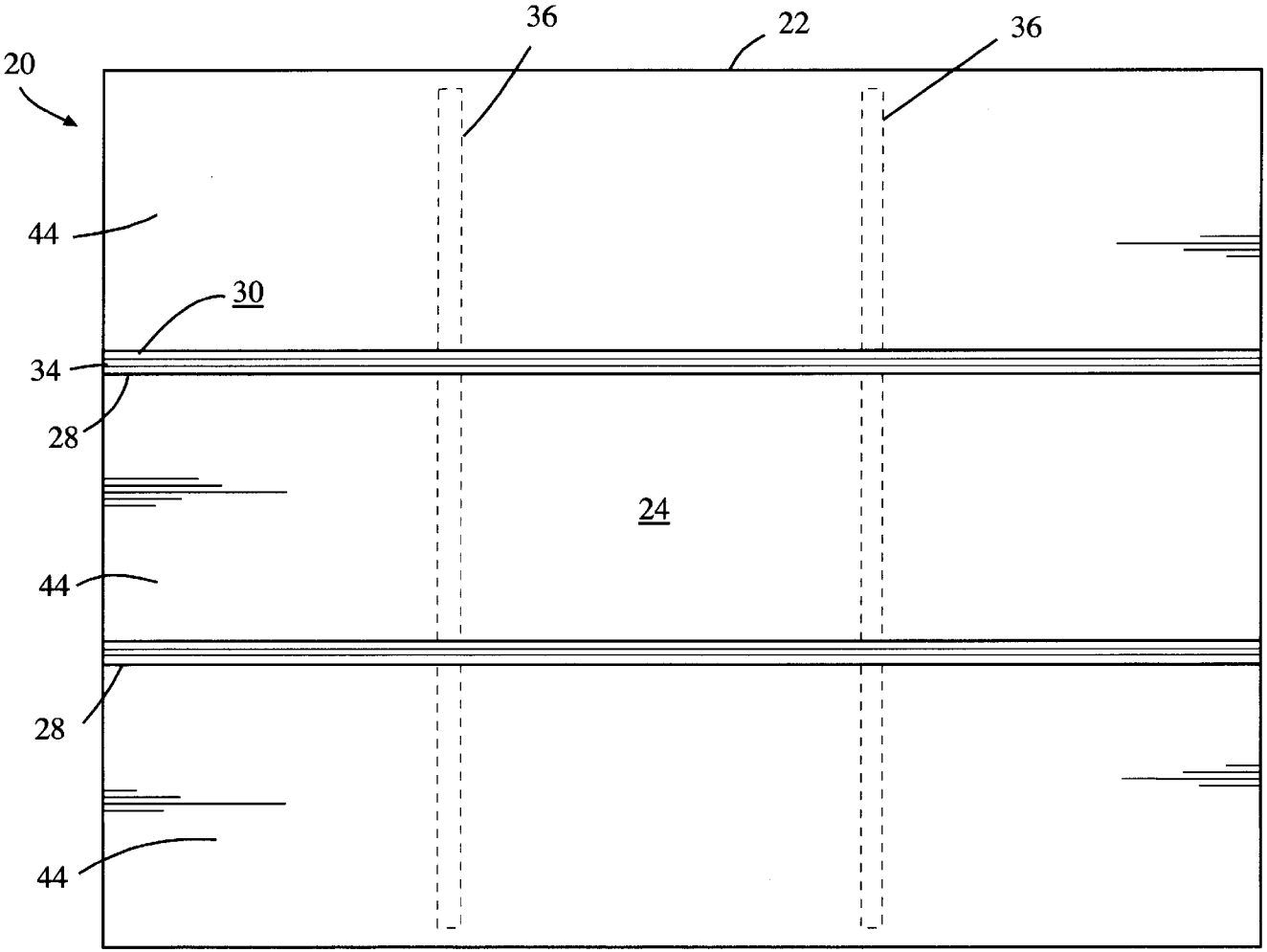
FIG. 1 is a top plan view of a tabletop assembly for securing articles in accordance with the present invention.
Figure 2:
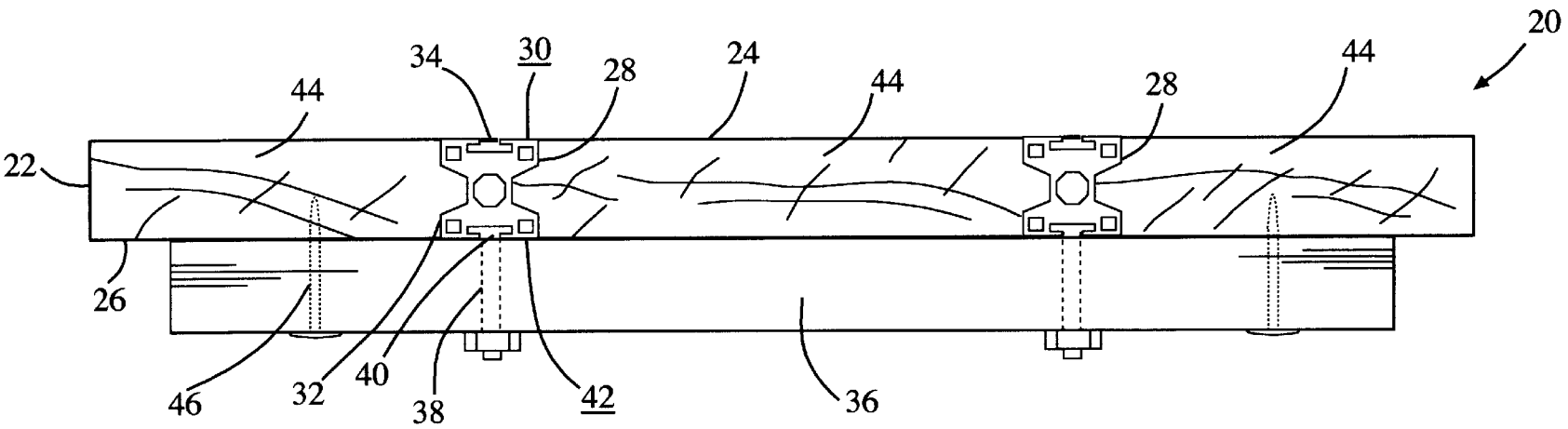
FIG. 2 is an enlarged end elevation view.

Referring initially to FIGS, 1, 2, and 3, there are illustrated top plan, enlarged end elevation, and perspective views respectively of a tabletop assembly for securing articles in accordance with the present invention, generally designated as 20. Tabletop assembly includes a tabletop 22 having a substantially planar top surface 24 and an opposite bottom surface 26. At least one track 28 is inset into tabletop 22. In the shown embodiment there are two tracks 28 spaced apart in substantially parallel relationship, however any plurality of spaced tracks 28 could also be employed. Track 28 has a top surface 30 and a bottom 32, top surface 30 being substantially coplanar with top surface 24 of tabletop 22. Track 28 has an upward-facing longitudinal attachment slot 34. In a preferred embodiment, upward-facing longitudinal attachment slot 34 is a conventional "T-slot" suited for accepting a "T-connector".

A brace 36 is disposed beneath bottom surface 26 of tabletop 22, and in a preferred embodiment comprises a longitudinal member which abuts bottom surface 26 and is oriented substantially perpendicular to tracks 28. In the shown embodiment there are two braces 36 spaced apart in substantially parallel relationship, however any plurality of spaced braces 36 could also be employed. In fact, brace 36 could comprise a substantially planar member which abuts bottom surface 26. Brace 36 is connected by a connector 38 to the bottom 32 of each track 28 so that tracks 28 cannot lift out of tabletop 22 when exposed to accelerations such as those associated with a seismic event. In a preferred embodiment, bottom 32 of track 28 has a downward-facing longitudinal attachment slot 40, a T-slot, with a T-connector 38 which can slide in attachment slot 40 effecting the attachment of track 28 to brace 36. Also in a preferred embodiment, bottom 32 of track 28 has a bottom surface 42 which is substantially flush with bottom surface 26 of tabletop 22.

Tabletop 22 consists of a plurality of tabletop segments or leafs 44 which are separated by tracks 28. Each brace 36 is connected by at least one connector 46 to each tabletop segment 44 thereby transforming the tabletop segments 44 and interspersed tracks 28 into a ridged and structurally sound tabletop assembly 20. For additional structural integrity, tabletop segments 44 and tracks 28 can be dovetailed together.

Figure 3:
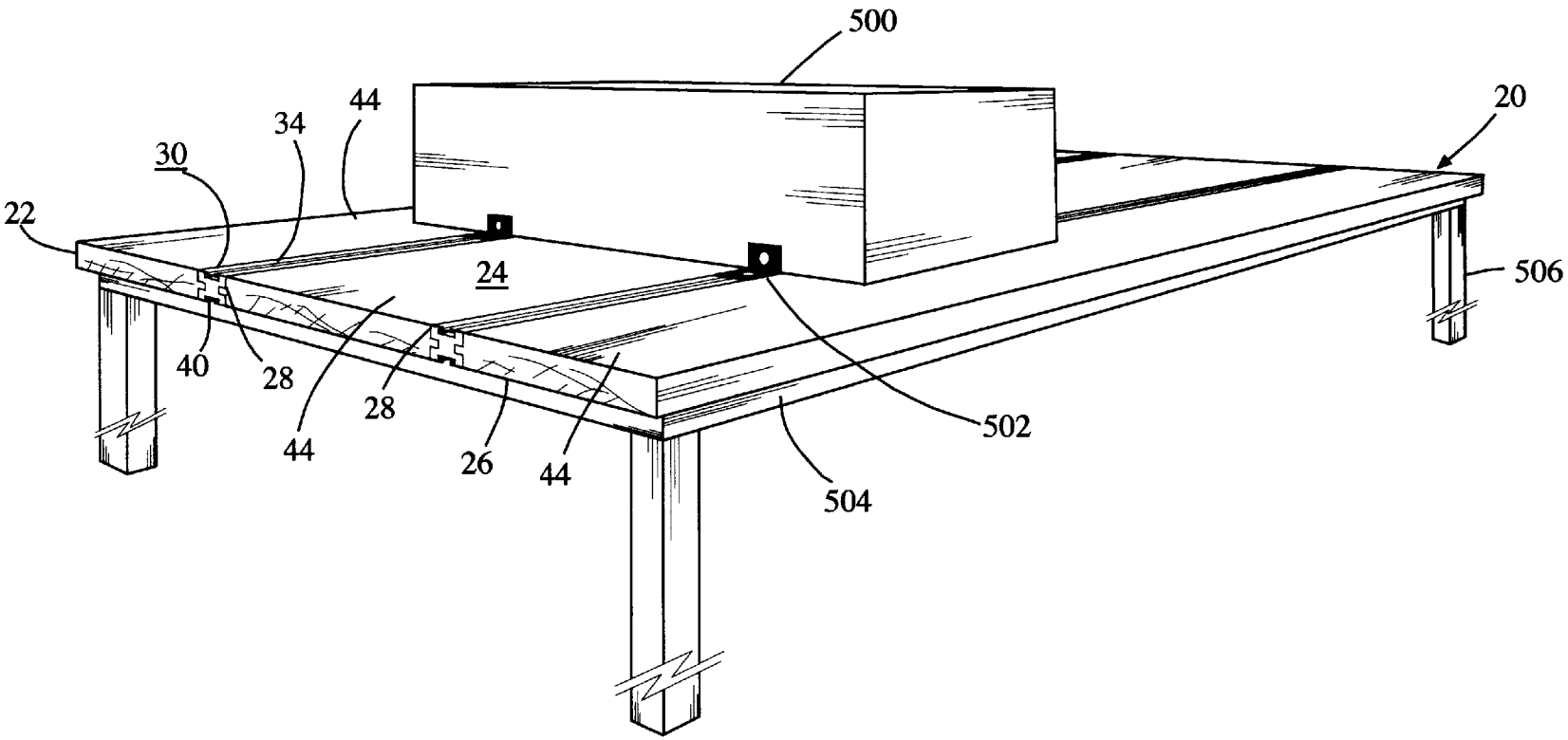
FIG. 3 is a perspective view of the tabletop assembly installed on a support structure.

As is shown in FIG. 3, a workpiece article 500 such as an electronic device is attached to tabletop assembly 20. Connection means 502, for example T-connectors, firmly attach article 500 to tracks 28 so that article 500 is held flat against tabletop 22. Tabletop assembly 20 is attached to a support frame 504 and legs 506 by conventional bolts or screws. In an additional embodiment (not shown), convenient storage elements such as drawers, paper trays, or the like may be attached to the bottom T-slots 40 of track 28.

Figure 4:
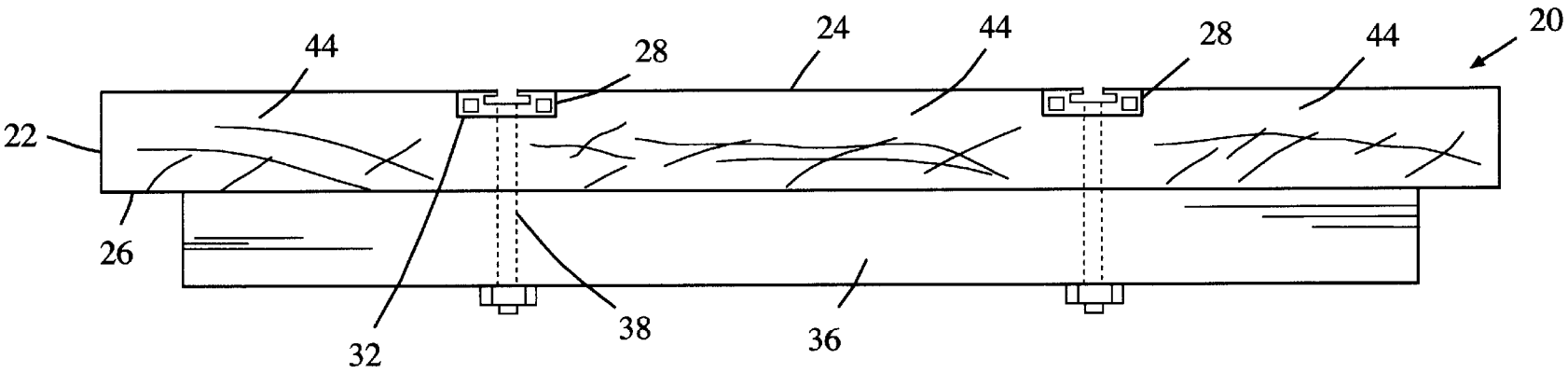
FIG. 4 is an enlarged end elevation view of an alternative track embodiment.

FIG. 4 is an enlarged end elevation view of an alternative embodiment of tabletop assembly 20. In this embodiment, track 28 does not extend to bottom surface 26 of tabletop 22, and does not have a downward-facing attachment slot. Rather, track 28 is connected to brace 36 by a conventional connector 38 such as a bolt which passes through tabletop 22.

Figure 5:
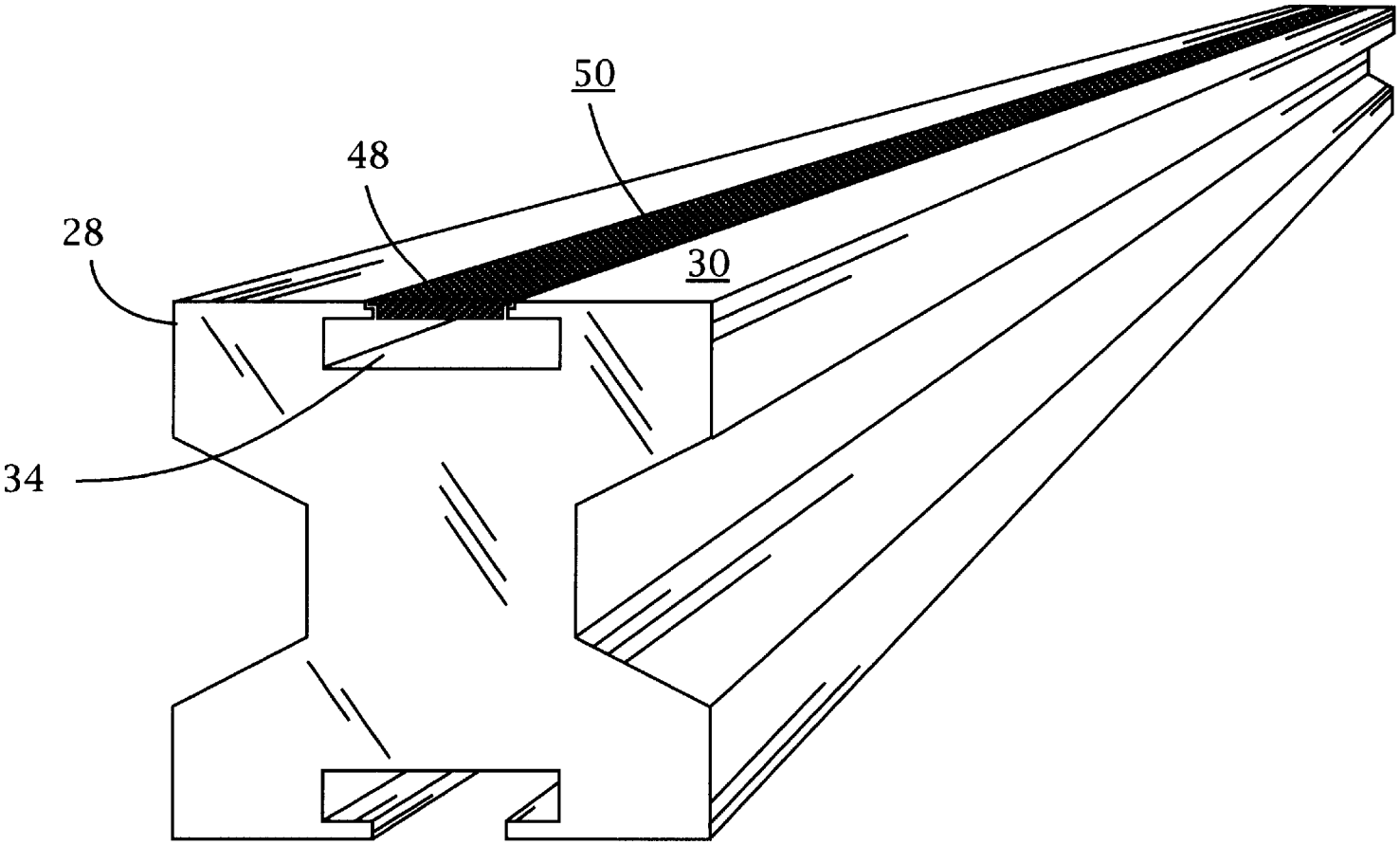
FIG. 5 is an enlarged perspective view showing a cap for selectively covering an upward-facing longitudinal attachment slot; and, FIG. 6 is a perspective view of a shelf embodiment.

FIG. 5 is an enlarged perspective view of a cap 48 for selectively covering upward-facing longitudinal attachment slot 34. Cap 48 prevents the intrusion of dust, dirt, and foreign objects into attachment slot 34. Additionally, cap 48 has a top surface 50 which is substantially coplanar with top surface 30 of track 28, and therefore when installed, transforms tabletop 22 into a slot-free flat planar surface suitable for writing or other desktop activities. A plurality of caps 48 can be cut into desired length so as to fit around articles installed on tabletop assembly 20.

Figure 6:
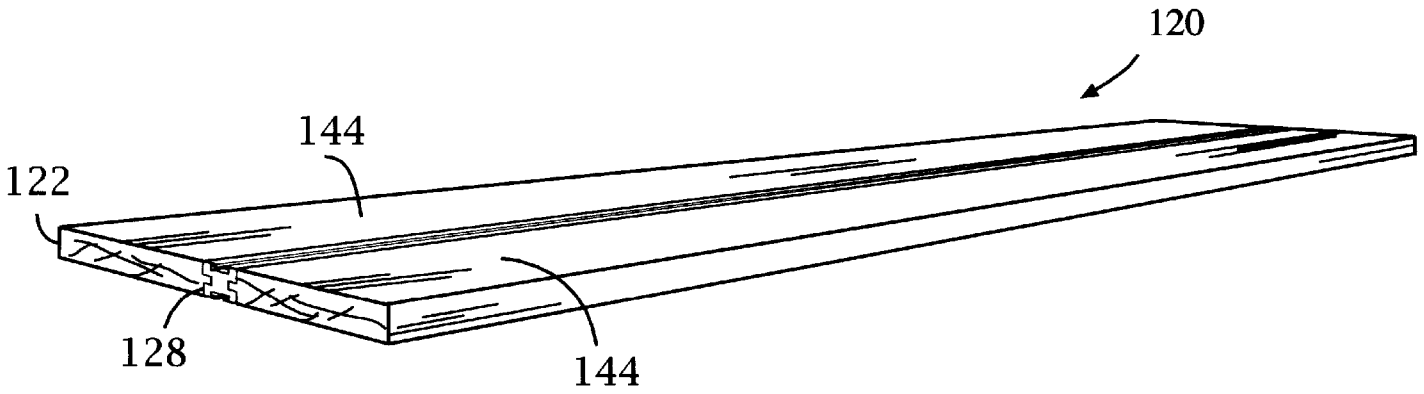

FIG. 6 is a perspective view of a shelf embodiment of the present invention, generally designated as 120. Shelf embodiment 120 has all the features of the tabletop assembly 20, but is specifically designed as a shelf rather than a tabletop. A shelftop 122 consisting of two shelf segments 144 has an inset track 128. A brace(s) 136 (hidden) holds track 128 in place and shelf segments 144 together.

Tabletop 22 should be fabricated from a ridged material such as wood, metal, a strong polymer, or a combination thereof. In a preferred embodiment, track 28 is fabricated from extruded aluminum, however for added strength track 28 could be fabricated from steel. Brace 36 should also be fabricated from a ridged material such as wood, metal, a strong polymer, or a combination thereof.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A tabletop assembly for securing articles, comprising:

a substantially planar tabletop having a top surface and an opposite bottom surface;

at least one track inset into said tabletop, said track having a top surface and a bottom, said top surface of said track being substantially coplanar with said top surface of said tabletop;

said track having an upward-facing longitudinal attachment slot;

a brace disposed beneath said bottom surface of said tabletop; and, said brace connected to said bottom of said track so that said track cannot lift out of said tabletop.

2. A tabletop assembly according to claim 1, said upward-facing longitudinal attachment slot being a T-slot.

3. A tabletop assembly for securing articles, comprising:

a substantially planar tabletop having a top surface and an opposite bottom surface;

at least one track inset into said tabletop, said track having a top surface and a bottom, said top surface of said track being substantially copolar with said top surface of said tabletop;

said track having an upward-facing longitudinal attachment slot;

a brace disposed beneath said bottom surface of said tabletop;

said brace connected to said bottom of said track so that said track cannot lift out of said tabletop;

said bottom of said track having a downward-facing longitudinal attachment slot; and, a connector connecting said downward facing-longitudinal attachment slot to said brace.

4. A tabletop assembly according to claim 3, said downward-facing longitudinal attachment slot being a T-slot.

5. A tabletop assembly according to claim 3, further including:

said bottom of said track having a bottom surface; and, said bottom surface of said track substantially flush with said bottom surface of said tabletop.

6. A tabletop assembly according to claim 1, further including:

said tabletop having a plurality of said tracks spaced apart in substantially parallel relationship;

said brace comprising a longitudinal member oriented substantially perpendicular to said tracks, said brace connected to said bottom of each said track.

7. A tabletop assembly according to claim 6, further including:

said tabletop including a plurality of tabletop segments separated by said tracks;

said brace connected to the bottom surface of each said segment.

8. A tabletop assembly according to claim 6, further including:

a plurality of said braces spaced apart in substantially parallel relationship.

9. A tabletop assembly for securing articles, comprising:

a substantially planar tabletop having a top surface and an opposite bottom surface;

at least one track inset into said tabletop, said track having a top surface and a bottom, said top surface of said track being substantially coplanar with said top surface of said tabletop;

said track having an upward-facing longitudinal attachment slot;

a brace disposed beneath said bottom surface of said tabletop;

said brace connected to said bottom of said track so that said track cannot lift out of said tabletop;

a cap for selectively covering said upward-facing longitudinal attachment slot; and, when so covered, said cap having a top surface substantially coplanar with said top surface of said track.

* * * * *